United States Patent [19]

Katz

[11] 4,076,156

[45] Feb. 28, 1978

[54] SAFETY HOLSTER

[76] Inventor: Menasha Emanuel Katz, 6102 Pimlico Road, Baltimore, Md. 21209

[21] Appl. No.: 663,626

[22] Filed: Mar. 3, 1976

[51] Int. Cl.[2] ..... F41C 33/02

[52] U.S. Cl. ..... 224/2 B

[58] Field of Search ..... 224/2 B, 2 C, 2 D, 1 R, 224/5 R, 5 A, 5 B, 5 H, 26 R

[56] References Cited

U.S. PATENT DOCUMENTS

| | | | |
|---|---|---|---|
| 1,747,454 | 2/1930 | Mees | 224/2 B |
| 2,297,008 | 9/1942 | McMillan | 224/2 B |
| 2,601,586 | 6/1952 | Brice | 224/2 B |
| 2,917,213 | 12/1959 | Bucheimer et al. | 224/2 B |
| 3,011,687 | 12/1961 | Boyt | 224/2 B |

*Primary Examiner*—Trygve M. Blix
*Assistant Examiner*—Jerold M. Forsberg
*Attorney, Agent, or Firm*—Morton J. Rosenberg

[57] ABSTRACT

A safety holster adapted to receive a gun and prevent removal of the gun from the safety holster by unauthorized personnel or through inadvertent movement by the user. The safety holster includes a tubular insert section within which the gun is inserted. A gun securement mechanism for constraining the gun within the tubular insert section provides for a strap element which passes from a frontal to a rear wall of the tubular insert section. The strap member passes over and contiguously contacts the hammer of a gun which is inserted within the safety holster. The strap member is positioned to intersect the path of removal of the gun from the holster. Additionally, the strap member is fixedly secured to a frontal wall of the tubular insert member but may be rotational with respect thereto. The strap member is releasably fastened to the rear wall of the tubular insert section through a pair of snap fasteners. The strap member contiguous to the rear wall of the tubular insert member extends beyond a boundary contour to provide a tab element through which the user may with a minimum of motion, releasably detach the snap fasteners. Further, the tab member section of the strap includes a rigid plate in order to prevent flexing of the strap member in the vicinity of the snap fasteners.

12 Claims, 4 Drawing Figures

SAFETY HOLSTER

BACKGROUND OF THE INVENTION

1. Field of the Invention

This invention pertains to gun holsters. In particular, this invention relates to gun safety holsters which constrain the gun within the holster. Still further, this invention pertains to safety gun holsters which include a strap member intersecting the path of removal of the gun from the holster. Additionally, and more in particular, this invention relates to safety gun holsters wherein the strap member is released from a rear wall of the holster adjacent to the body of the user. Still further, this invention pertains to safety holsters which optimize the difficulty of unauthorized personnel from removing the gun from the holster.

2. Prior Art

Holsters for releasably constraining guns therein are known in the art. However, in some prior gun holsters, a separate appendage passes from a rear wall of the holster over the entire gun to provide an encasement therefore. In such prior systems, the appendage may be removed from the frontal portion of the holster by release of a snap fastening mechanism or some like releasable detachment device in one easy motion by unauthorized personnel. Thus, such safety devices allow both the authorized and the unauthorized personnel to easily remove the gun from its constrained position. This allows the unauthorized personnel to remove the gun in the same way that the authorized personnel would do and such will increase the risk of the unauthorized personnel from removing the gun from its holster during an attack on the wearer.

In other types of prior safety holsters, a strap mechanism passes from the frontal portion of the holster to a rear portion of the holster and is released by a snap fastener attached to the frontal portion of the holster. Once again, in such prior types of safety holsters, release of the strap member is from the frontal wall of the holster insert and both authorized and unauthorized personnel may remove the gun in one motion.

In some other types of gun safety holsters utilizing strap members passing from a frontal wall to a rear wall of the holster, the strap members are releasably detached from both the frontal and rear walls. Once again, both the authorized and unauthorized personnel may remove the strap securing mechanism in one motion and this optimizes the possibility of the unauthorized personnel snatching the gun out of the holster mechanism.

Some of these prior safety holsters are directed to maintaining the gun within the holster insert when an inadvertent motion is made by the authorized user. However, such prior safety holsters do not materially aid in preventing unauthorized personnel in removal of the gun from the holster tubular insert as is provided in the instant invention mechanism.

SUMMARY OF THE INVENTION

A safety holster which comprises a tubular insert member which extends in a substantially longitudinal direction and is adapted in contour for the insertion of a gun. The tubular insert mechanism includes a frontal wall member and a rear wall member. A gun securement device is provided for releasably capturing the gun at least partially within the tubular insert member. The gun securement device is fixedly fastened to the frontal wall and releasably fastened to the rear wall member of the tubular insert element.

DESCRIPTION OF THE PREFERRED EMBODIMENTS

Referring now to FIGS. 1–4 there is shown safety holster 10 for maintaining gun 12 therein and preventing removal of gun 12 by unauthorized personnel. Additionally, safety holster 10 prevents removal of gun 12 during movement by the wearer. Holster 10 may be releasably mounted to belt 14 or some other member attached to the body of an authorized person.

In overall concept, safety holster 10 allows the user to easily remove gun 12 from captured restraint within holster 10 while at the same time preventing someone who is unauthorized from removing gun 12 from within holster 10. As will hereinafter be described, the particular construction details of safety holster 10 optimally prevents an unauthorized person from removing gun 12 in one motion as has been the case in some prior holster mechanisms. Removal of the gun restraint is maximized in difficulty in that grasping of gun 12 with a removal motion will not release the constraining mechanisms.

Figure 1:
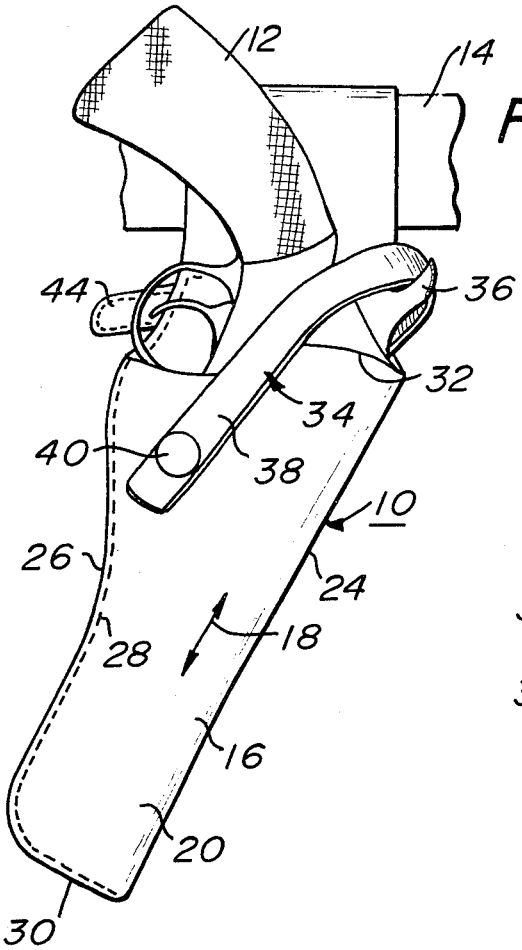
FIG. 1 is a frontal elevation view of the safety holster.
Figure 2:
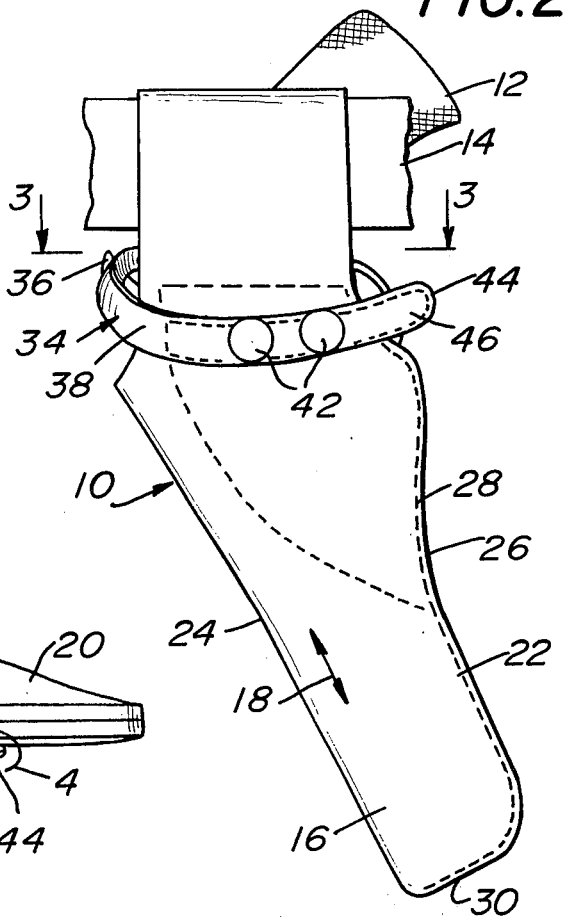
FIG. 2 is a rear elevation view of the safety holster.

Safety holster 10 includes tubular insert section or element 16 which is contoured and adapted for insertion of gun 12. Tubular insert element 16 extends in longitudinal direction 18 for receiving gun 12 as is shown in FIGS. 1 and 2. Section 16 includes frontal wall member 20 and rear wall member 22 formed in partially closed contour. Frontal wall member 20 and rear wall member 22 may be folded around frontal boundary 24 and mated each to the other at rear boundary contour 26 through stitching 28 or some like securing mechanism.

As will be understood, when safety holster 10 is positioned on the body of a user, rear wall member 22 will lie adjacent and contiguous a body portion of the user. Safety holster 10 includes opposing longitudinal end sections 30 and 32 between which gun 12 is captured in releasable restraint. Additionally, longitudinal end section 32 of safety holster 10 includes an opening for insertion of gun 12. Tubular insert element 16 including frontal and rear wall members 20 and 22 may generally be made of leather or some other pliable material, not important to the inventive concept of the instant invention.

Figure 3:
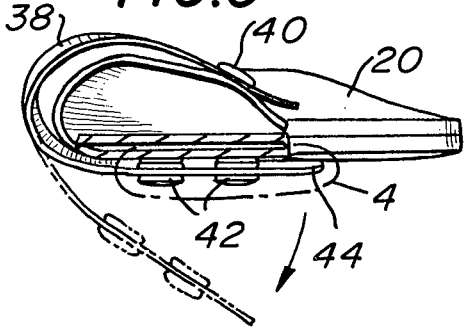
FIG. 3 is a sectional view of the safety holster taken along the section lines 3—3 of FIG. 2; and, FIG. 4 is a sectional enlarged view of a portion of the releasable detachment mechanism of the safety holster shown in FIG. 3.

Gun securement mechanism 34 as is shown in FIGS. 1, 2 and 3 releasably captures gun 12 at least partially within tubular insert element 16. Gun securement mechanism 34, as will be shown in following paragraphs is fixedly secured or fastened to frontal wall 20 and further releasably fastened to rear wall member 22. Additionally, securement mechanism 34 is mounted to frontal wall member 20 as is shown in FIG. 1 and passes in its extended length to rear wall member 22 as is shown in FIG. 2.

Positional placement of mechanism 34 provides for a blocking member to intersect the path of removal of gun 12 from tubular insert element 16. Securement mechanism 34 passes in a substantially longitudinal direction 18 over gun hammer 36 and is fastened to rear wall member 22 in order to prevent removal of gun 12 in longitudinal direction 18. Thus, in overall concept gun securement mechanism 34 is seen to extend over an opening in tubular insert element 16 adjacent to longitudinal end 32 and passes from frontal wall member 20 to rear wall member 22. As can be seen, securement mechanism 34 is in contiguous contact with hammer 36 of the gun 12 and is fitted in a recess thereof in order that mechanism 34 does not slip out of contact with gun 12 during normal movements of the operator.

Gun securement mechanism 34 is formed of a strap element 38 which extends from frontal wall member 20 to rear wall member 22. As has been stated, strap member 38 is positionally located to intersect the path of removal of gun 12 from safety holster 10 when gun 12 is captured within tubular insert element 16. Strap member 38 is mounted to frontal wall member 20 by a fixed pivot mechanism 40. Fixed pivot mechanism 40 is mounted to strap member 38 and frontal wall member 20 to permit rotational displacement of strap member 40 with respect to frontal wall member 20. Fixed pivot mechanism 40 may be in the form of a rivet which is adapted to permit rotational movement of strap member 38 when taken with respect to frontal wall member 20. Additionally, rivet member or fixed pivot mechanism 40 may resemble a snap fastener in order to confuse unauthorized personnel into thinking that fixed pivot member 40 may be released from frontal wall member 20.

Of importance, is that strap member 38 is fixedly secured to frontal wall member 20 when taken with respect to a releasable detachment. However, strap member 38 may be rotated with respect to frontal wall member 20 although not removable therefrom.

Figure 4:
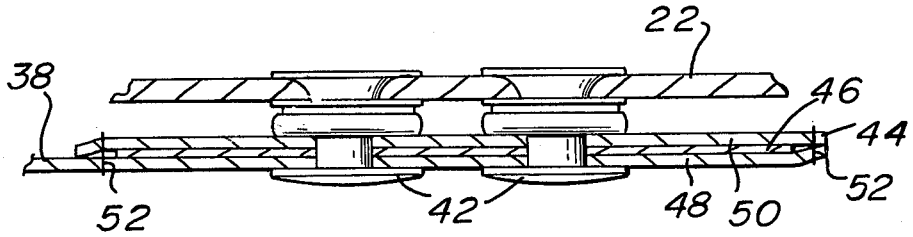

Referring now to FIGS. 2, 3 and 4, gun securement mechanism 34 and the rear section of strap member 38 includes releasable detachment mechanism 42 mounted to strap member 38 and rear wall member 22 of tubular insert element 16. Releasable detachment mechanism 42 may be a pair of snap fasteners mounted on a rear section of strap member 38 for releasable attachment to rear wall member 22 of tubular insert element 16. Thus, by providing a force load on strap member 38 in the direction of the body of the user, gun securement mechanism 34 is released from gun hammer 36 and gun 12 is able to be removed from tubular insert 16.

Strap member 38 extends in a substantially transverse direction to longitudinal direction 18 in the portion of strap member 38 which is contiguous to rear wall member 22 of tubular insert member 16. As can be seen, snap fasteners 42 provide for releasable detachment of strap member 38 from rear wall 22 while at the same time constraining any rotational motion of strap member 38 with respect to rear wall 22 of insert member 16. In this way, the positional location of strap member 38 and overall gun securement mechanism 34 is well known to the operator and will be positionally located in the same area throughout securement mechanism 34 use.

Strap member 38 extends beyond contour boundary or rear boundary contour 26 to provide tab member 44 for release of strap member 38 from tubular insert 16. Extension of tab member 44 beyond the boundary contour 26 is of importance in that the operator can easily displace strap member 38 from rear wall member 22. Thus, the authorized personnel in order to release gun securement mechanism 34 can press tab member 44 with a force loading in the direction of the body and remove snap fasteners 42 from a restraining position.

Referring now to FIGS. 2 and 4, in order to provide some rigidity to the portion of strap member 38 which is to be removed from rear wall member 22, plate member 46 is inserted as shown. Plate member 46 may be secured within the portion of strap member 38 which is contiguous to rear wall member 22 to form a rigid section of strap member 38. As is seen in FIG. 4, plate 46 may be sewn or otherwise fastened between opposing flexible strap elements 48 and 50.

Plate member 46 may include a pair of openings through which snap fasteners or releasable detachment mechanism 42 may be fitted to rear wall member 22. Opposing flexible strap elements 48 and 50 may be secured each to the other through stitching 52 or some like securing mechanism not important to the inventive concept. Member 46 may be formed of steel or some like material. The rigidity imposed by plate member 46 insures that when tab member 44 is force loaded by the user, that strap member 38 will not bend or otherwise flex in the neighborhood of snap fasteners 42. This rigidity allows snap fasteners 42 to detach in one easy motion to provide quick release of gun 12 from captured restraint within tubular insert element 16.

As will be understood, when unauthorized personnel reach and grasp for strap member 38 of gun securement mechanism 34, that there will be no release from fixed pivot mechanism section 40. The force applied by unauthorized personnel will tend to pull releasable detachment mechanisms 42 in either a longitudinal direction 18 or in a combined longitudinal direction 18 and a normal direction away from the body of the user which would only tend to maintain securement mechanism 34 in a constrained position for gun 12.

Unauthorized personnel would necessarily have to reach around safety holster 10 and push tab member 44 towards the body of the user and then in a separate motion pull up gun 12 in longitudinal direction 18 to provide release thereof. This maximizes the amount of effort and motion that an unauthorized personnel must go through in order to release gun 12 from a constrained locational position. This will give additional time to the user to prevent such from happening.

Although this invention has been described in connection with specific forms and embodiments thereof, it will be appreciated that various modifications other than those discussed above may be resorted to without departing from the spirit or scope of the invention. For example, equivalent elemental structures may be substituted for those specifically shown and described, certain features may be used independently of other features, and in some cases, elements may be reversed, all without departing from the spirit or scope of the invention as defined in the appended claims.

What is claimed is:

1. A safety holster for minimizing unauthorized removal of a gun from said safety holster confines, comprising:

a. tubular insert means extending in a substantially longitudinal direction and adapted in contour for insertion of said gun, said tubular insert means having a frontal wall member and a rear wall member;

b. gun securement means extending in continuous relation from said frontal wall to a location behind said rear wall for releasably capturing said gun at least partially within said tubular insert means;

c. fixed attachment means fixedly fastening in a pivotal relation to said frontal wall member one end of said gun securement means thereby providing relative rotation of said gun securement means relative to said frontal wall member; and, d. releaseable detachment means for securing said gun securement means to and behind said rear wall member of said tubular insert means, said gun securement means extending in a substantially transverse direction to said longitudinal direction adjacent said rear wall member, said gun securement means extending beyond a contour boundary of said rear wall member in said transverse direction.

2. The safety holster as recited in claim 1 where said releasable detachment means is non-rotational with respect to said rear wall member.

3. The safety holster as recited in claim 1 where said gun securement means includes strap means extending from said frontal wall member to said rear wall member, said strap means being positionally located to intersect a path of removal of said gun from said safety holster when said gun is captured within said tubular insert means.

4. The safety holster as recited in claim 3 where said gun securement means includes fixed pivot means mounted to said strap means and said frontal wall for permitting rotational displacement of said strap means with respect to said frontal wall member.

5. The safety holster as recited in claim 4 where said fixed pivot means includes a rivet member adapted to permit rotational movement of said strap means with respect to said frontal wall member.

6. The safety holster as recited in claim 3 where said gun securement means includes releasable detachment means mounted to said strap means and said rear wall member of said tubular insert means.

7. The safety holster as recited in claim 6 where said releasable detachment means includes at least one snap fastening means mounted to said strap means and said rear wall member.

8. The safety holster as recited in claim 6 where said releasable detachment means includes a pair of snap fastening members mounted to said strap means and said rear wall member of said tubular insert means.

9. The safety holster as recited in claim 1 where said strap means extends beyond said contour boundary of said rear wall member to provide a tab member for release of said strap means from said tubular insert means.

10. The safety holster as recited in claim 3 where said strap means includes rigidity means formed within a portion of said strap means at least partially contiguous with said rear wall member.

11. The safety holster as recited in claim 10 where said rigidity means includes a plate member secured within said portion of said strap means contiguous said rear wall member to form a rigid section of said strap means.

12. The safety holster as recited in claim 11 where said rigid section of said strap means extends beyond a boundary contour of said tubular insert means to provide a release tab member for said strap means.

* * * * *